United States Patent [19]

Amici et al.

[11] Patent Number: 4,576,586

[45] Date of Patent: Mar. 18, 1986

[54] CORD-CLIMBING CREATURE

[75] Inventors: Francis R. Amici, Northford; Hans S. Berger, Plainville; Richard I. Farrington, New Britain; Pietro Piazza, Prospect, all of Conn.

[73] Assignee: Coleco Industries, Inc., West Hartford, Conn.

[21] Appl. No.: 703,333

[22] Filed: Feb. 20, 1985

[51] Int. Cl.[4] ..... A63H 11/04

[52] U.S. Cl. ..... 446/315; 446/390; 446/382

[58] Field of Search ..... 446/315, 314, 268, 390, 446/490, 365, 376, 382

[56] References Cited

U.S. PATENT DOCUMENTS

| | | | |
|---|---|---|---|
| 485,713 | 11/1892 | Shattuck | 446/315 |
| 545,958 | 9/1885 | Hoffman | 446/315 |
| 1,267,608 | 5/1918 | Vaughan | 446/315 |
| 1,462,090 | 7/1923 | Lindstrom | 446/315 |
| 2,618,889 | 11/1952 | Wigal | 446/390 X |
| 3,328,910 | 7/1967 | Huges | 446/315 |
| 3,346,989 | 10/1967 | Ryan et al. | 446/268 X |
| 3,935,667 | 2/1976 | Vitt | 446/444 |
| 3,983,661 | 10/1976 | Zitzmann | 446/315 |
| 4,216,612 | 8/1980 | Erickson et al. | 446/382 X |

*Primary Examiner*—Mickey Yu

[57] ABSTRACT

A cord-climbing simulated creature has a body comprised of a bottom section and a top section with apertures on each side through which extend legs from a common web member disposed on each side. On the outer surface of the top section of the creature's body is an upstanding post. A winch assembly in the body includes a housing and a winch which has a pair of axially spaced winch sections of different diameter. An elongated flexible string member extends about the smaller diameter winch section and out the front end of the simulated creature and has its outer end attached to a hook element. The opposite end of the string-like member extends about the larger diameter winch section and out through the rear of the creature's body and its outer end is secured to a spool which is adapted to coil the string-like member thereabout and to seat on the post formed on the body member.

14 Claims, 9 Drawing Figures

CORD-CLIMBING CREATURE

BACKGROUND OF THE INVENTION

Toys which will climb along a string or wall are old and well known and have been employed in a number of play environments. In some instances, the toy may move along the length of the string on a horizontal surface as opposed to climbing vertically therealong. Frequently the toys simulate the shape of animals or humans and humanoids.

Although some structures employ mechanical actuation by springs or electrically driven motors to cause the toy to move along the string, it is also known to use the weight of the toy to provide the climbing action vertically by reason of the differential in diameters of two spool surfaces around which the cord is wound and unwound. Exemplary of such devices are Shattuck U.S. Pat. No. 485,713 granted Nov. 8, 1892 and Zitzmann U.S. Pat. No. 3,983,661 granted Oct. 5, 1976.

It is an object of the present invention to provide a novel cord-climbing simulated creature which incorporates means for winding the cord and storing it as a part of the creature assembly.

It is also an object to provide such a creature which may be readily assembled from components which may be relatively economically fabricated and which are durable.

Another object is to provide such a creature which is capable of facile variation in design by single change of the external appearance of various of the creature elements.

SUMMARY OF THE INVENTION

It has now been found that the foregoing and related objects may be readily attained in a creature figure having a head, a body and legs. The creature's body is comprised of a bottom section and a top section secured together along transversely disposed abutting surfaces and defining a body cavity therebetween. These sections provide a multiplicity of spaced apertures along each side thereof and leg forming elements are disposed along these sides in the apertures. Each leg forming element includes a web portion in the body cavity extending along the side between the apertures and flexible leg portions which extend outwardly of the apertures from the web portion. The top section of the creature also provides an upstanding post on its outer surface adjacent its rearward end.

Seated in the body cavity is a winch assembly which includes a housing and a winch with a shaft supported for rotation within the housing. The winch has a first winch portion adjacent one axial end thereof and a second winch portion adjacent the other axial end thereof which has a diameter greater than that of the first winch portion. An elongated flexible string-like member has a first portion extending about the first winch portion, outwardly of an aperture in the front of the winch housing, and thence through an aperture in the head of the creature figure. The string-like member also has a second portion extending about the second winch portion, through an aperture in the rear of the winch housing, and thence through the rear portion of the creature figure.

Secured to the outer end of the first portion of the string-like member is a hook element which is configured to permit suspension of the creature thereby. Secured to the outer end of the second portion of the string-like member and adapted to coil the string-like member thereabout, is a spool which has a recess therein which seats on the post on the back surface of the creature figure.

In the preferred embodiment, the top and bottom sections of the creature figure have cooperating ribs thereon which define an enclosure in which is seated the winch assembly. The winch is integrally formed from synthetic resin with a core having axially extending ends providing the shaft, and the shaft is journalled in the winch housing.

In one embodiment of the invention, the winch has an axially extending channel therein communicating with a radially extending wall between the first and second winch portions. The first and second portions of the string-like member are parts of a continuous length with a portion of this length extending generally radially through an aperture in the circumferential wall defining the second winch portion, along the channel and thence through the radially extending wall of the winch onto the first winch portion of the winch.

The top and bottom sections of the creature figure are fabricated from synthetic resin and desirably have interfitting locating elements spaced thereabout in the cavity and the interfitting surfaces are bonded together to secure the winch assembly in position in the cavity. Most desirably, the leg forming elements are molded from a flexible synthetic resin, and the top and bottom sections of the body capture the leg forming elements to maintain the position thereof in the cavity. The post on the top section of the body and the spool recess are cooperatively dimensioned and configured to retain the spool in assembly on the post and to substantially prevent inadvertent uncoiling of the string-like member therefrom.

DETAILED DESCRIPTION OF THE ILLUSTRATED EMBODIMENT

Figure 1:
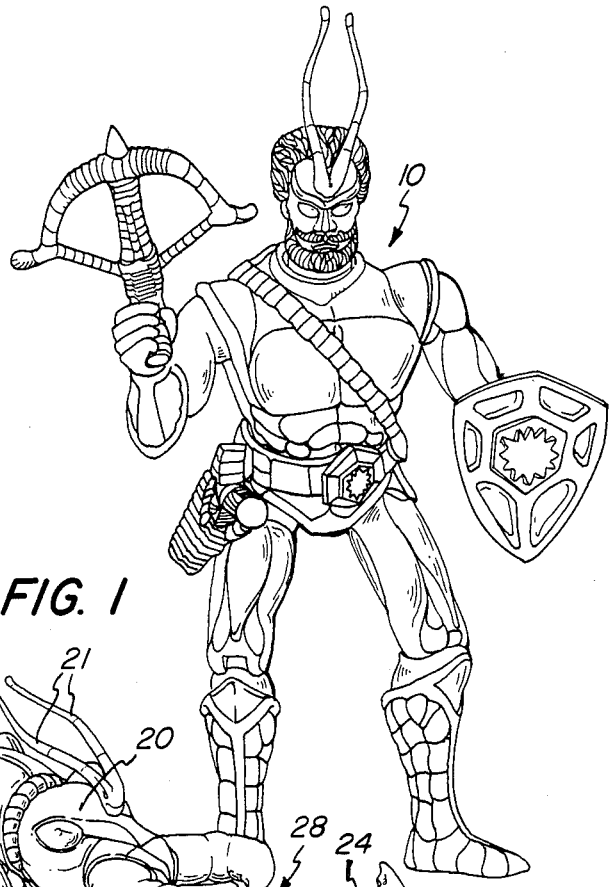
FIG. 1 is a perspective view of a cord-climbing creature embodying the present invention as associated with a related humanoid.
Figure 4:
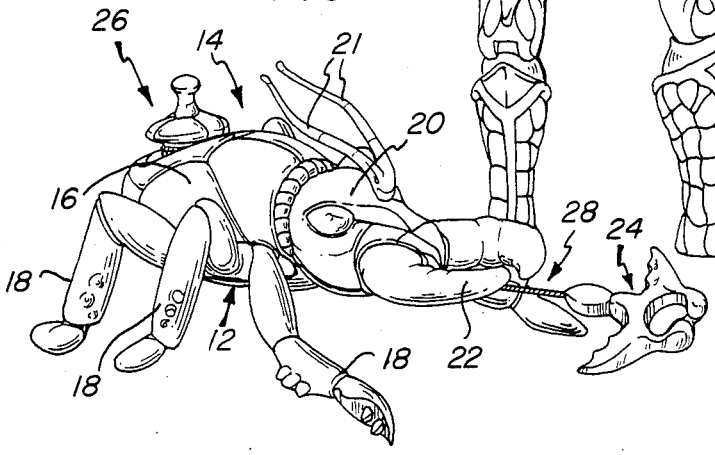
FIG. 4 is an end elevational view to an enlarged scale of the winch.
Figure 4:
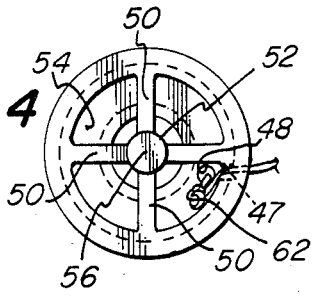

Turning first to FIG. 1, therein illustrated is a cord-climbing simulated creature embodying the present invention together with an associated humanoid generally designated by the numeral 10. The creature has a body comprised of a bottom section generally designated by the numeral 12 and a top section generally designated by the numeral 14. The sections 12,14 together define the torso 16 and head 20 of the creature, and extending outwardly along the sides thereof are a multiplicity of legs 18. Extending outwardly from the top of the head 20 are antennae 21 and extending forwardly from the front of the head are pincers 22. The creature also includes a hook element generally designated by the numeral 24 spaced to the front thereof, a spool generally designated by the numeral 26 seated in a recess in the back of the torso 16 and a string-like member generally designated by the numeral 28 extending from the forward end of the head 20 and engaged with the hook 24 and extending out the rearward end of the torso 16 and engaged with the spool 26.

Figure 5:
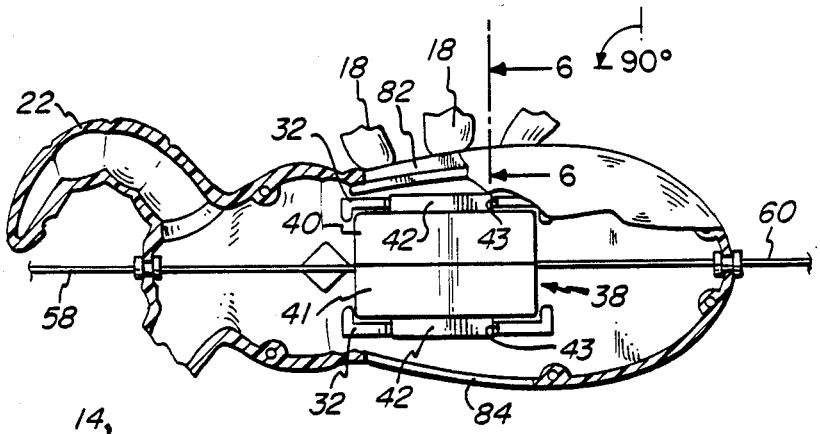
FIG. 5 is a fragmentary, partially sectioned view of the creature looking upwardly into the cavity showing the legs along one side.

It can be seen that the top section 14 has a pair of depending ribs 32 formed on its inner surface and that the bottom section 12 has an aligned pair of ribs 30 extending upwardly therefrom. The ribs 32 in the top section 14 have rectangular recesses 43 in their lower edges as best seen in FIG. 5 for a purpose to be described more fully hereinafter. Together the ribs 30,32 define an enclosure in which is seated the winch assembly generally designated by the numeral 38 and which has a generally rectangular configuration.

The winch assembly 38 is comprised of a pair of housing sections 40,41 which have horizontally extending bosses 42 on the sides thereof which are dimensioned and configured to seat in the rectangular recesses 43 formed in the top ribs 32 so as to effect firm placement of the winch assembly 38 within the cavity defined by the body sections 12,14.

Figure 9:
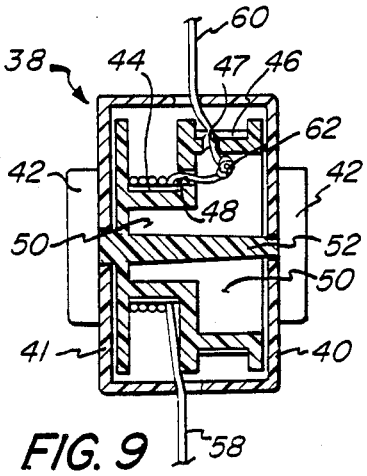
FIG. 9 is a sectional view of the winch assembly along the line 9—9 of FIG. 8.

Disposed within the cavity defined by the housing sections 40,41 is an integrally formed winch with a first winch section 44 of relatively small diameter and a second winch section 46 of relatively large diameter. The winch has a core 52 which extends beyond the side margins of the winch sections 44,46, thus providing shaft portions 56 which are journalled within the side walls of the housing sections 40,41 as best seen in FIG. 9. As a result, the winch will freely rotate within the housing sections 40,41.

The string-like member 28 includes a first portion 58 which extends about the small diameter winch portion 44 and outwardly through an aperture 68 in the front wall of the housing section 41 and through an eyelet 64 in the head 20 of the creature. Its outer end is attached to the hook 24.

Figure 2:
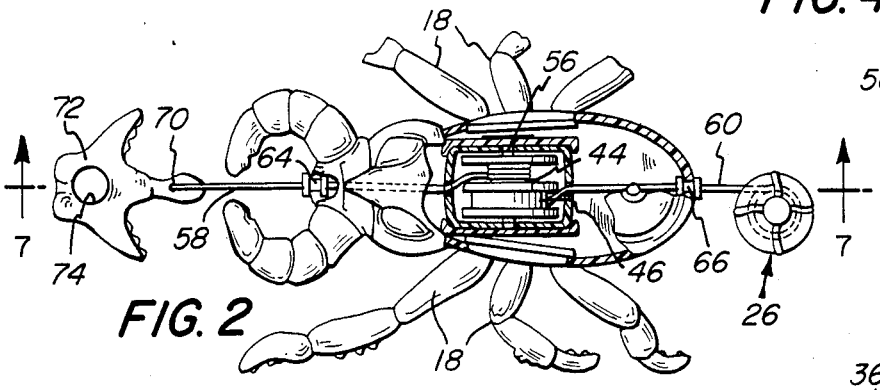
FIG. 2 is a top view of the creature with portions of the upper section of the body broken away to reveal internal structure and with the spool removed from its seating post.

As best seen in FIGS. 1 and 2, the hook 24 is comprised of the base 70, and the enlarged fanciful body portion 72 with an aperture 74 therein which provides the means for suspending the hook on a nail or the like for operation of the creature during play action.

The string-like member 28 also has a second portion 60 which extends about the winch section 46 of larger diameter and outwardly through an aperture 68 in the rear wall of the housing section 40 and thence outwardly through the eyelet 66 in the rear end of the torso 16 of the creature. Its outer end is secured to the spool 26.

In the illustrated embodiment, the string portions 58 and 60 are parts of a continuous string-like member 28. As best seen in FIG. 9, the string-like member 28 extends through a radial aperture 47 in the base wall of the winch section 46 along a channel between the core 62 and the base wall of the winch section 46. It then passes through an aperture 48 formed in the radial wall 54 between the two winch sections 44,46, and coils about the winch section 44. As seen the string-like member 28 has a knot 62 therein.

Figure 3:
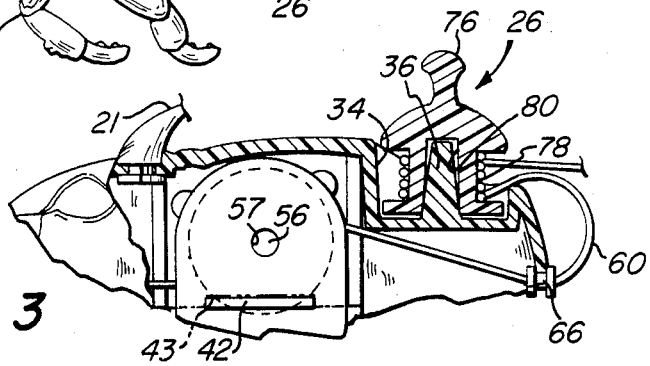
FIG. 3 is a fragmentary elevational view in partial section of the creature to illustrate internal construction.
Figure 7:
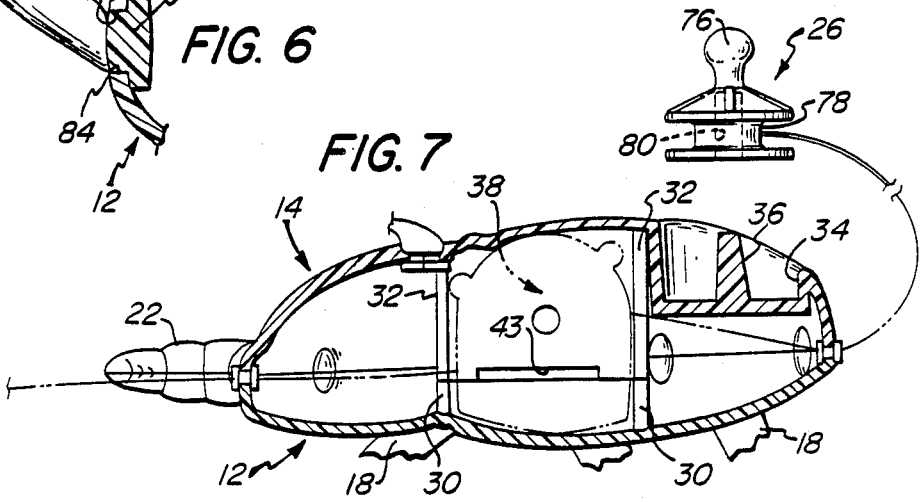
FIG. 7 is a fragmentary sectional view along the line 7—7 of FIG. 2 with the spool moved upwardly for ease of illustration.
Figure 8:
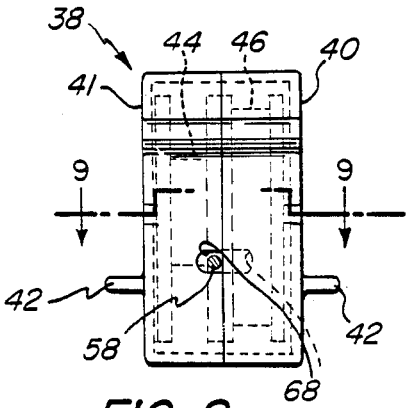
FIG. 8 is a front elevation view to an enlarged scale of the winch assembly.

Turning now in detail to the structure of the spool 26, this is best seen in FIGS. 3 and 7. The body of the spool 26 has a reduced diameter portion 78 about which the string-like member 28 may be coiled, and it has a centrally disposed recess extending upwardly thereinto. The upper portion of the spool 26 is configured to provide a finger grip 76 by which the spool 26 may be readily manipulated.

As also seen in FIGS. 3 and 7, the rearward upper surface of the top section 14 of the creature has a recess 34 formed therein with a centrally disposed upstanding post 36. The recess 80 in the spool 26 is cooperatively configured with respect to the post 36 so that the spool 26 will frictionally engage thereon to prevent inadvertent disassembly. Thus, the string-like member 28 may be coiled about the spool 26, and the spool 26 may be placed in a storage or fixed position upon the post 36 at the back of the creature when it is desired to maintain the creature in a fixed position on the string-like member 28 or to store the creature with its string-like member 28 fully coiled and contained.

Figure 6:
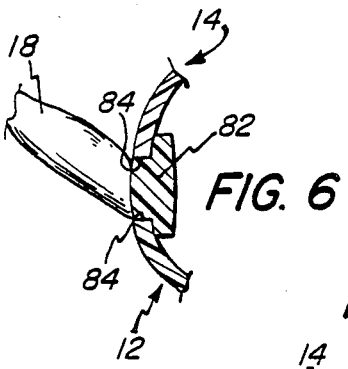
FIG. 6 is a fragmentary sectional view to a greatly enlarged scale of the leg mounting within the body of the creature.

As indicated in FIGS. 5 and 6, the body sections 12,14 have a series of aligned semi-circular apertures 84 cooperatively formed at the abutting transverse surfaces of these sections 12,14 and through which the legs 18 extend. The legs 18 have their inner ends secured to a continuous base or web 82, and this leg structure is captured within the apertures 84 upon assembly of the top and bottom sections 12,14.

Turning now to FIGS. 3 and 7, it can be seen that the antennae 21 are extensions from a base portion which seats snugly against the wall of the top section 14 about an aperture extending therethrough.

In assembling the creature of the illustrated embodiment, the antennae 21 are pushed through the aperture in the top section 14. The leg bases 82 are seated in the lower semi-circular apertures 84 formed in the bottom section 12 with the legs 18 extending outwardly therefrom.

The winch assembly 38 is separately assembled. Initially the string-like member 28 is led through the aperture 47 in the winch section 46 and the knot 62 is tied therein. The end of the string-like member 28 is then led through the axial aperture 48 in the radial wall 54 and onto the drum surface of the winch section 44. The winch structure is then enclosed within the two housing sections 40,41 with the string-portions 58 and 60 extending outwardly through the apertures 68 in the front and rear end walls and with the shaft ends 56 seating in apertures formed in the sidewalls of the house sections 40,41.

The two elements 40,41 of the winch housing are then bonded together by ultrasonic welding or by separate adhesive application, as may be desired. The string portions 58,60 are then led through the eyelets 64 and 66 and attached to the hook 24 and spool 26. At this point, the winch assembly 38 may be assembled upon the ribs 30 in the body cavity of the bottom body section 12. The eyelets 64,66 are seated in the semi-circular portions of the apertures provided in the head 20 and in the rear portion of the torso 16 of the bottom section 12. The top section 14 of the body is then assembled with the recess 34 in the ribs 32 trapping the bosses 42 on the housing sections 40,41 of the winch assembly 38 to securely position the winch assembly 38 in the body cavity. The semi-circular apertures formed in the top section 14 trap the eyelets 64,66 and the legs 18 therebetween so that all elements are then positively positioned. The two sections 12,14 are then bonded together by either an interposed adhesive or by ultrasonic welding or the like.

In operation of the creature, the hook 24 is secured on a nail or other structure by which the creature may be suspended. The length of the forwardly extending first portion 58 of the string-like member determines the length of the climb which the creature can effect. The spool 26 is removed from the post 36 and at this point gravity will cause the string-like member 28 to wind up more rapidly about the smaller diameter winch portion 44, causing the creature to "climb" up the string portion 58. When the play action has ceased, the string portion 60 which is extending rearwardly from the creature may be wound about the spool 26 and the spool 26 firmly seated upon the post 36 for storage.

As will be readily appreciated, the various elements of the structure are readily fabricated from synthetic resin. As such, the appearance of the creature may be modified by changing of molds. The elements of the structure may be relatively economically fabricated and the structural assembly is one which can be conveniently effected. The several elements may be secured together by a separate adhesive coating or by generation of a bonding interface such as by ultrasonic welding techniques. As also indicated in the drawings, locating pins and recesses may be provided at spaced points about the interfitting body sections to facilitate their alignment.

Although the string-like member has been illustrated as a continuous string member, it may also comprise two separate string elements, one associated with each of the winch sections.

From the foregoing detailed specification and attached drawings, it will be readily appreciated that the creature of the present invention is one providing highly desirable play action and ease of storage of the string member about a storable spool. The elements comprising the structure may be readily fabricated from synthetic resin and assembled conveniently and quickly to provide a relative durable structure. Moreover, the body sections for the creature may be modified in appearance by changing the mold configuration to enable a high degree of versitility. The integrally formed winch member facilitates fabrication of the assembly and contributes to long life.

Having thus described the invention, what is claimed is:

1. A cord-climbing simulated creature comprising:

A. a creature figure having a head, a body and legs, said creature body being comprised of a bottom section and a top section secured together along transversely disposed abutting surfaces and defining a body cavity therebetween, said sections providing apertures along each side thereof, a pair of leg forming elements including a web portion in said body cavity extending along a side of said body and flexible leg portions extending outwardly of said apertures from said web portion, said top section also providing an upstanding post on its outer surface adjacent its rearward end;

B. a winch assembly seated in said body and including a housing and a winch with a shaft supported for rotation within said housing, said winch having a first winch portion adjacent one axial end thereof and a second winch portion adjacent the other axial end thereof having a diameter greater than that of said first winch portion;

C. an elongated, flexible string-like member having a first portion extending about said first winch portion of said winch and outwardly of an aperture in the front of said winch assembly housing and thence through an aperture in the head of said creature figure, said string-like member having a second portion extending about said second winch portion of said winch and thence outwardly through an aperture in the rear of said winch housing and thence through the rear portion of said creature figure;

D. a hook element secured to the outer end of said first portion of said string-like member, said hook element being configured to permit suspension of said creature thereby; and E. a spool secured to the outer end of said second portion of said string-like member and adapted to coil the string-like member thereabout, said spool having a recess therein seating said post therein.

2. The cord-climbing creature in accordance with claim 1 wherein said top and bottom sections of said creature figure have ribs thereon defining an enclosure in which is seated said winch assembly.

3. The cord-climbing creature in accordance with claim 1 wherein said winch is integrally formed from synthetic resin with a core having axially extending ends providing said shaft, said shaft being journalled in said winch housing.

4. The cord-climbing creature in accordance with claim 3 wherein said winch has an axially extending channel therein communicating with a radially extending wall between said first and second winch portions, said first and second portions of said string-like member being parts of a continuous length with a portion of said length extending generally radially through an aperture in the circumferential wall defining said said second winch portion of said winch, along said channel, and thence through said radially extending wall of said winch onto said first winch portion of said winch.

5. The cord-climbing creature in accordance with claim 1 wherein said top and bottom sections of said creature figure are fabricated from synthetic resin, have interfitting locating elements spaced thereabout in said cavity, and are bonded together to secure said winch assembly in position in said cavity.

6. The cord-climbing creature in accordance with claim 1 wherein said leg forming elements are molded from a flexible synthetic resin and wherein said top and bottom sections define a multiplicity of apertures along the length of each side in which are captured said leg forming elements to maintain the position thereof.

7. The cord-climbing creature in accordance with claim 1 wherein said post on said top section and said spool recess are cooperatively dimensioned and configured to retain said spool in assembly on said post and substantially prevent inadvertent uncoiling of said string-like member therefrom.

8. A cord-climbing simulated creature comprising:

A. a creature figure having a head, a body and legs, said creature body being comprised of a bottom section and a top section secured together along transversely disposed abutting surfaces and defining a body cavity therebetween, said top section providing an upstanding post on its outer surface adjacent its rearward end;

B. a winch assembly seated in said body and including a housing and a winch with a shaft supported for rotation within said housing, said winch having a first winch portion adjacent one axial end thereof and a second winch portion adjacent the other axial end thereof having a diameter greater than that of said first winch portion, said winch being integrally formed from synthetic resin with a core providing axially extending ends providing said shaft, said shaft being journalled in said winch housing, said top and bottom sections of said creature figure having oppositely extending ribs therein defining an enclosure in which is seated said winch assembly;

C. an elongated, flexible string-like member having, a first portion extending about said first winch portion of said winch and outwardly of an aperture in said winch assembly housing and thence through an aperture in the head of said creature figure, said string-like member having a second portion extending about said second winch of said winch and thence outwardly through an aperture in said winch housing and thence through the rear portion of said creature figure;

D. a hook element secured to the outer end of said first portion of said string-like member, said hook element being configured to permit suspension of said creature thereby; and E. a spool secured to the outer end of said second portion of said string-like member and adapted to coil the string-like member thereabout, said spool having a recess therein seating said post therein.

9. The cord-climbing creature in accordance with claim 8 wherein said winch has an axially extending channel therein communicating with a radially extending wall between said first and second winch portions, said first and second portions of said string-like member being parts of a continuous length with a portion of said length extending generally radially through an aperture in the circumferential wall defining said said second winch portion of said winch, along said channel, and thence through said radially extending wall of said winch onto said first winch portion of said winch.

10. The cord-climbing creature in accordance with claim 8 wherein said post on said top section and said spool recess are cooperatively dimensioned and configured to retain said spool in assembly on said post and substantially prevent inadvertent uncoiling of said string-like member therefrom.

11. A cord-climbing simulated creature comprising:

A. a creature figure having a head, a body, and legs, said creature body being comprised of a bottom section and a top section secured together along a transversely disposed abutting surfaces and defining a body cavity therebetween, said sections providing apertures along each side thereof, a pair of leg forming elements including a web portion in said body cavity extending along a side of said body and flexible leg portions extending outwardly of said aperture from said web portion, said top section providing an upstanding post on its outer surface adjacent its rearward end;

B. a winch assembly seated in said body and including a housing and a winch with a shaft supported for rotation within said housing, said winch having a first winch portion adjacent one axial end thereof and a second winch portion adjacent the other axial end thereof having a diameter greater than that of said first winch portion;

C. an elongated, flexible string-like member having, a first portion extending about said first winch portion of said winch and outwardly of an aperture in said winch assembly housing and thence through an aperture in the head of said creature figure, said string-like member having a second portion extending about said second winch of said winch and thence outwardly through an aperture in said winch housing and thence through the rear portion of said creature figure, said top and bottom sections of said creature figure having ribs therein defining an enclosure in which is seated said winch assembly, said top and bottom sections of said creature figure being fabricated from synthetic resin, having interfitting locating elements spaced thereabout in said cavity, and being bonded together to secure said winch assembly in position in said cavity;

D. a hook element secured to the outer end of said first portion of said string-like member, said hook element being configured to permit suspension of said creature thereby; and E. a spool secured to the outer end of said second portion of said string-like member and adapted to coil the string-like member thereabout, said spool having a recess therein seating said post therein, said post on said top section and said spool recess being cooperatively dimensioned and configured to retain said spool in assembly on said post and substantially prevent inadvertent uncoiling of said string-like member therefrom.

12. The cord-climbing creature in accordance with claim 11 wherein said leg forming elements are molded from a flexible synthetic resin and wherein said top and bottom sections capture said leg forming elements to maintain the position thereof.

13. The cord-climbing creature in accordance with claim 11 wherein said winch is integrally formed from synthetic resin with a core having axially extending ends providing said shaft, said shaft being journalled in said winch housing.

14. The cord-climbing creature in accordance with claim 11 wherein said winch has an axially extending channel therein communicating with a radially extending wall between said first and second winch portions, said first and second portions of said string-like member being parts of a continuous length with a portion of said length extending generally radially through an aperture in the circumferential wall defining said said second winch portion of said winch, along said channel, and thence through said radially extending wall of said winch onto said first winch portion of said winch.

* * * * *